US006040973A

United States Patent [19]

Okamoto et al.

[11] Patent Number: 6,040,973

[45] **Date of Patent: *Mar. 21, 2000**

[54] METHOD OF DRIVING A FIELD EMISSION COLD CATHODE DEVICE AND A FIELD EMISSION COLD CATHODE ELECTRON GUN

[75] Inventors: Akihiko Okamoto; Fuminori Ito, both of Tokyo, Japan

[73] Assignee: NEC Corporaiton, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/014,577

[22] Filed: Jan. 28, 1998

[30] Foreign Application Priority Data

Jan. 28, 1997 [JP] Japan ..... 9-013923

[51] Int. Cl.[7] ..... G09G 3/10

[52] U.S. Cl. ..... 361/235; 315/161.9

[58] Field of Search ..... 361/212, 213, 361/225, 229, 230–235, 220; 250/324–326; 96/63, 95, 97; 315/169.1

[56] References Cited

U.S. PATENT DOCUMENTS

| | | | |
|---|---|---|---|
| 4,090,106 | 5/1978 | Okumura et al. | 315/107 |
| 4,596,945 | 6/1986 | Schumacher | 315/344 |
| 5,012,153 | 4/1991 | Atkinson | 313/336 |
| 5,189,341 | 2/1993 | Itoh et al. | 315/169.1 |
| 5,280,221 | 1/1994 | Okamoto et al. | 315/169.1 |
| 5,700,175 | 12/1997 | Wang et al. | 445/24 |
| 5,719,477 | 2/1998 | Tomihari | 315/381 |
| 5,721,472 | 2/1998 | Browning et al. | 315/169.1 |

*Primary Examiner*—Jeffrey Gaffin
*Assistant Examiner*—Kim Huynh
*Attorney, Agent, or Firm*—Sughrue, Mion, Zinn, Macpeak & Seas, PLLC

[57] ABSTRACT

A field emission cold cathode device is driven to make an emission current constant without limiting the available choice of materials for a gate electrode. A positive voltage with reference to OV is applied from a gate power supply to gate electrode of the field emission cold cathode device to enable emitter disposed respectively near the gate electrode to emit electrons. After the positive voltage with reference to OV is applied, a negative voltage with reference to OV is applied from the gate power supply to the gate electrode at a predetermined time.

9 Claims, 9 Drawing Sheets

METHOD OF DRIVING A FIELD EMISSION COLD CATHODE DEVICE AND A FIELD EMISSION COLD CATHODE ELECTRON GUN

BACKGROUND OF THE INVENTION

1. Field of the Invention

The present invention relates to a method of driving a field emission cold cathode device having a minute emitter and minute gate electrodes disposed near the emitters, and a field emission cold cathode electron gun.

2. Description of the Related Art

Field emission cold cathode devices have a sharply pointed conical emitter, a gate electrode having an opening of submicron size and disposed near the emitter, and an anode electrode. When voltages are applied to the gate electrode and the anode electrode, a high electric field is concentrated on the tip end of the emitter to enable the emitter to emit electrons from its tip end in a vacuum.

As shown in FIG. 1 of the accompanying drawings, an emitter 1 is mounted on a substrate 2 which is either electrically conductive or electrically insulative with an electrically conductive film. A gate electrode 3 is connected to a gate power supply 14 and disposed a in surrounding relation to the tip end of the emitter 1. An anode electrode 5 is connected to an anode power supply 6 and disposed in a confronting relation to the tip end of the emitter 1.

Positive voltages with reference to OV are applied from the gate electrode power supply 14 and the anode electrode power supply 6 respectively through the gate electrode 3 and the anode electrode 5 to the emitter 1 for enabling the emitter 1 to emit electrons from its tip end.

The electrons are normally emitted from a small region of the tip end of the emitter which has a length of 10 nm or less. The emitted electrons are affected by gases remaining in the vacuum.

When the gate voltage applied to the gate electrode is controlled as shown in FIG. 2*a* of the accompanying drawings, an emission current which represents electrons emitted from the emitter flows according to the Fowler-Nordheim equation:

$$J = \alpha \times e^{-\frac{\beta}{V^2}} \tag{1}$$

where J is the work function at the tip end of emitter and V is the field intensity generated by the configuration of the emitter near its tip end, and α, β are constants, α depending on the area from which the electrons are emitted and β depending on the work function at the tip end of the emitter and the field intensity generated by the configuration of the emitter near its tip end.

When the gate voltage shown in FIG. 2*a* is applied to the gate electrode, the emission current increases as the gate voltage increases, as shown in FIG. 2*b*. Thereafter, the emission current gradually decreases toward a certain value and becomes stable. The change in the emission current is caused because a small amount of gases remaining in the vacuum is adsorbed to the tip end of the emitter thereby to reduce the effective area for emitting electrons or increase the work function of the surface of the emitter, changing the constants α, β of the Fowler-Nordheim equation.

One way of stabilizing the varying emission current is to provide transistors and resistor layers and use a constant-current regulated power supply circuit. For example, Japanese laid-open patent publication No. 1994-290701 discloses resistors disposed between emitter electrodes and emitters for stabilizing the varying emission current.

The above process of stabilizing the varying emission current by providing transistors and resistor layers and using a constant-current regulated power supply circuit is problematic in that a method of driving the device is complex, it is difficult to operate the device at high frequencies because of the capacitance and resistance of the added transistors, and the consumption by the device of electric energy is large.

Japanese laid-open patent publication No. 1992-332423 discloses a gate electrode made of a material which can be combined with oxygen more strongly than the material of the emitter, for thereby preventing active residual gases such as of oxygen from being adsorbed to the emitter surface and reacting with the emitter to increase the work function.

However, if the gate electrode is made of a material which can be combined with oxygen more strongly than the material of the emitter in order to stabilize the varying emission current, there is a limited choice of materials available for the gate electrode, which can be combined with oxygen more strongly than the material of the emitter and lend themselves to microfabrication, and the gate electrode tends to become lower in reliability when oxidized.

SUMMARY OF THE INVENTION

It is therefore an object of the present invention to provide a method of driving a field emission cold cathode device to make an emission current constant without limiting the available choice of materials for a gate electrode, and provide a field emission cold cathode electron gun.

When a positive voltage is applied to a gate electrode of a field emission cold cathode device in order to emit electrons from an emitter thereof, negative ions of residual gases in an apparatus for driving the field emission cold cathode device are attracted to the emitter and adsorbed to the surface of the emitter, reducing an emission current. However, when a negative voltage is applied to the gate electrode, gases adsorbed to the surface of the emitter are released therefrom, and the surface of the emitter is cleaned.

According to the present invention, there is provided a method of driving a field emission cold cathode device, comprising the steps of applying a positive voltage to a plurality of gate electrodes disposed respectively near a plurality of emitters, and applying a negative volt age to the gate electrodes at a predetermined time. Gases which are adsorbed to the surface of the emitters when the positive voltage is applied are released from the surface of the emitters when the negative voltage is applied, thereby preventing an emission current from the emitters from being reduced.

With this arrangement, the emission current is kept constant without making operation of the field emission cold cathode device complex and also without limiting the available choice of materials for the gate electrodes.

The emission current may also be kept constant if the ratio of the product of the absolute value of the negative voltage and a period of time in which to apply the negative voltage to the product of the absolute value of the positive voltage and a period of time in which to apply the positive voltage is set to a predetermined ratio.

The emission current may further be kept constant by controlling the value of the negative voltage and a period of time in which to apply the negative voltage is set to a predetermined value such that when the emission current is smaller than a predetermined setting, the absolute value of the negative voltage is increased or the period of time in which the negative voltage is applied is increased, and when the emission current is greater than the predetermined setting, the absolute value of the negative voltage is reduced or the period of time in which the negative voltage is applied is reduced.

The above method of driving a field emission cold cathode device may be applied to a field emission cold cathode electron gun. A current detecting means detects an emission current from the emitters when the positive voltage is applied to the gate electrodes, and a comparing means compares an emission current detected by the current detecting means with a predetermined value and producing an output signal indicative of a compared result. A voltage controlling means controls the value of the negative voltage applied from the gate power supply to the gate electrode and a period of time in which to apply the negative voltage, based on the compared result from the comparing means.

In the field emission cold cathode electron gun, the emission current is kept constant by the current detecting means, the comparing means, and the voltage controlling means.

The emission current can thus be kept constant without making operation of the field emission cold cathode device complex and also without limiting the available choice of materials for the gate electrodes. As a result, if the field emission cold cathode is applied to a display device, luminance changes or irregularities and color shifts or irregularities can be reduced which would otherwise be caused by variations in the emission current. If the field emission cold cathode device is applied to a beam source such as a traveling-wave tube, electron source noise and signal drifts can be reduced.

The above and other objects, features, and advantages of the present invention will become apparent from the following description with reference to the accompanying drawings which illustrate examples of the present invention.

DETAILED DESCRIPTION OF THE PREFERRED EMBODIMENTS

Figure 1:
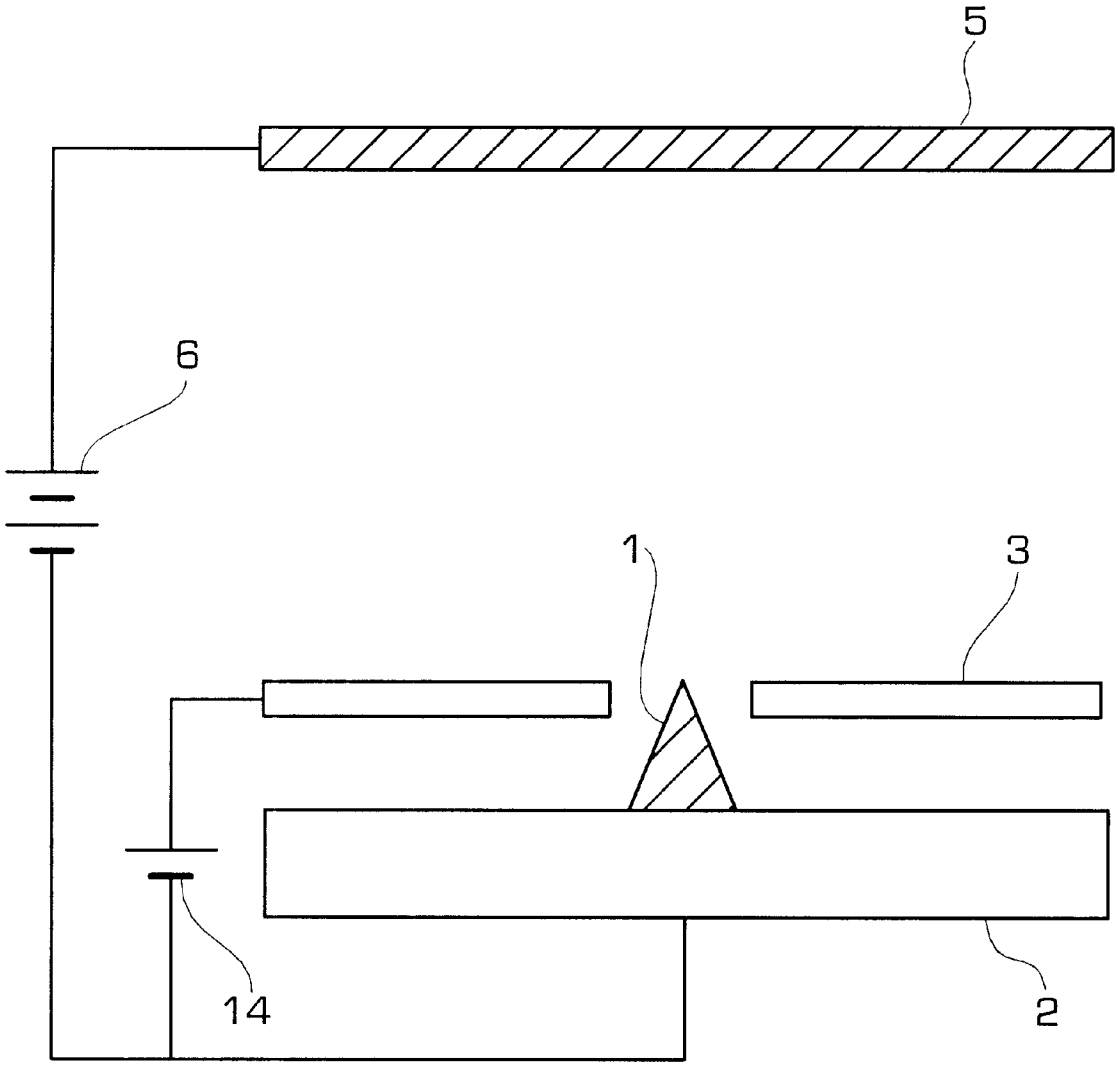
FIG. 1 PRIOR ART
FIG. 1 is a diagram of a driving apparatus to which a conventional method of driving a field emission cold cathode device is applied.
Figure 2A:
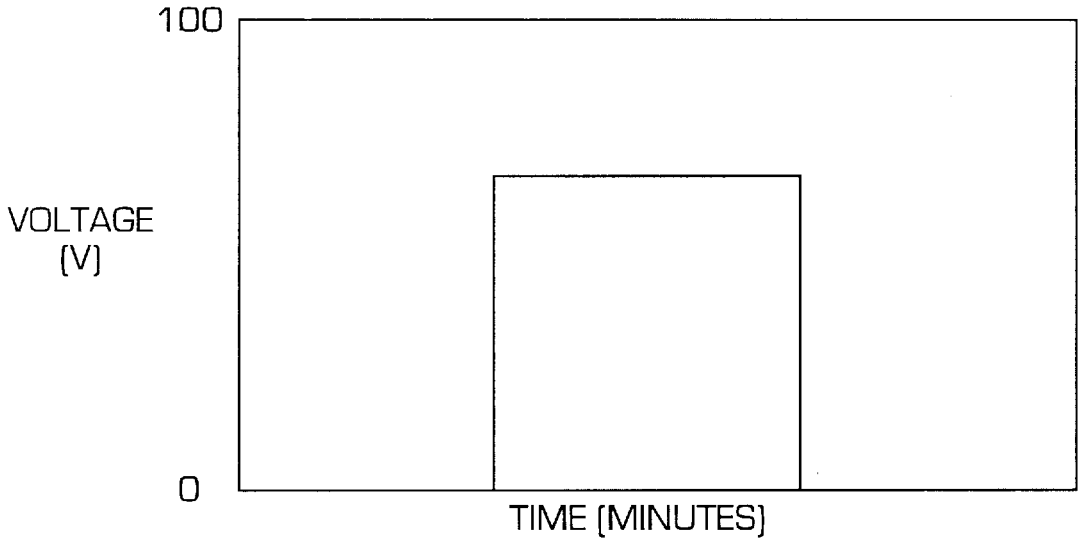
FIG. 2*a* is a diagram showing the value of a gate voltage applied to a gate electrode in the driving apparatus for driving the field emission cold cathode device shown in FIG. 1.
Figure 2B:
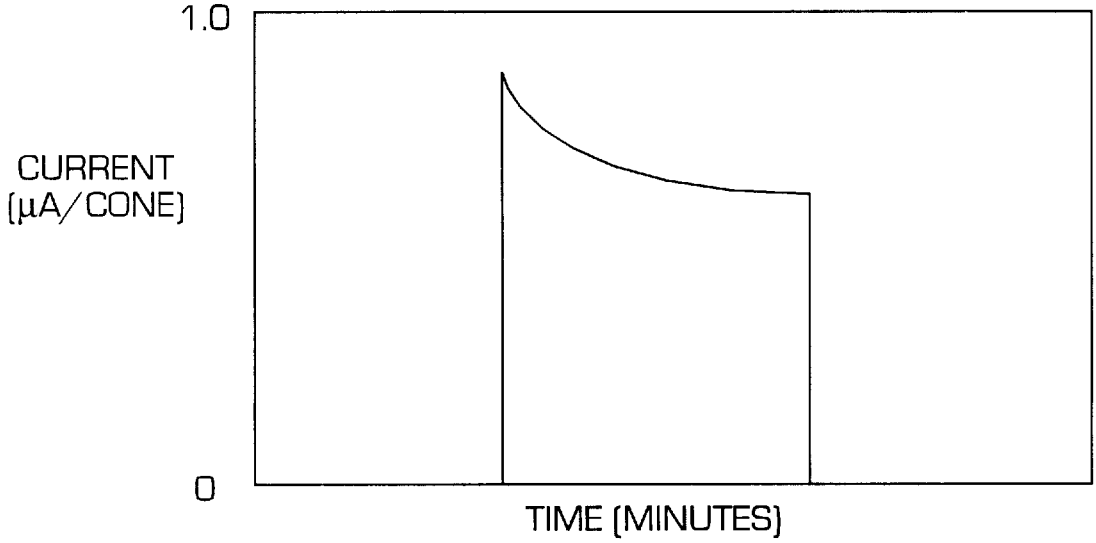
FIG. 2*b* is a diagram showing the value of an emission current which varies with the gate voltage shown in FIG. 2*a;*
Figure 3:
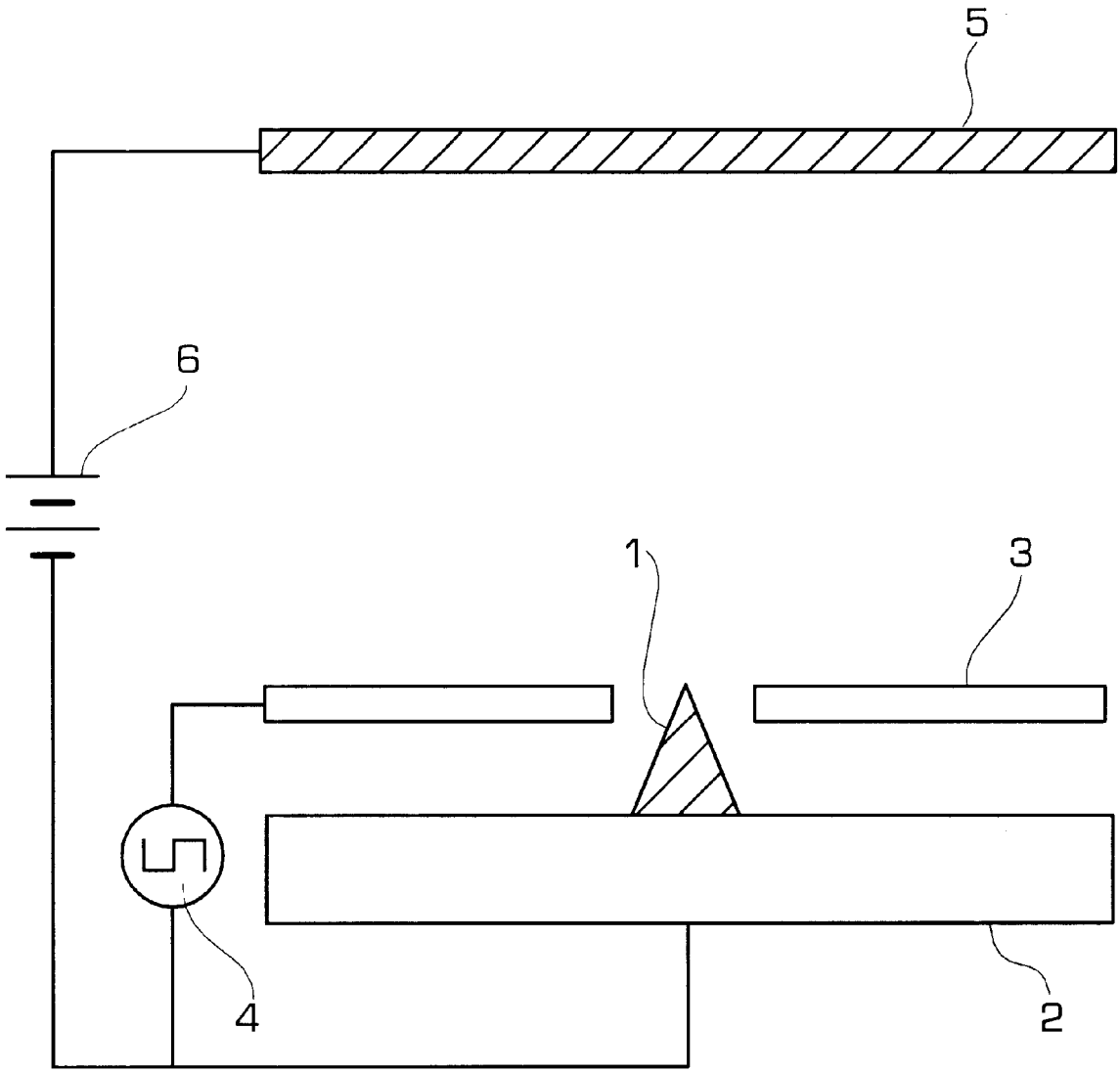
FIG. 3 is a diagram of a driving apparatus to which a method of driving a field emission cold cathode device according to an embodiment of the present invention is applied.

As shown in FIG. 3, a driving apparatus to which a method of driving a field emission cold cathode device according to an embodiment of the present invention is applied has a conical emitter 1 mounted on a substrate 2 which is either electrically conductive or electrically insulative with an electrically conductive film. A gate electrode 3 is connected to a gate power supply 4 for applying a positive or negative voltage to the gate electrode 3. The gate electrode 3 is disposed in a surrounding relationship to the tip end of the emitter 1 and has an opening having a diameter of 0.8 $\mu$m. An anode electrode 5 is connected to an anode electrode power supply 6 for applying a positive voltage to the anode electrode 5 and disposed on confronting relation to the tip end of the emitter 1. The field emission cold cathode device has the emitter 1, the gate electrode 3, and the anode electrode 5 in a plurality of combinations.

The method of driving a field emission cold cathode device in the driving apparatus shown in FIG. 3 will be described below.

The driving apparatus is mounted on a metal chamber (not shown), which is then evacuated to a pressure of $1\times10^{-7}$ pascal by a turbo molecular pump.

Then, the field emission cold cathode device is heated to 450° C., and gases in the metal chamber are discharged, cleaning the surface of the field emission cold cathode device.

Thereafter, a positive voltage of 70 V is applied from the gate power supply 4 to the plural gate electrodes 3 for thereby enabling the emitters 1 to emit electrons in terms of 1 $\mu$A per emitter.

However, remaining gases in the metal chamber, such as hydrogen, oxygen, organic substances, and so on, are ionized and positively charged, and attracted and adsorbed to the emitters 1. Therefore, the area of the emitters 1 for emitting electrons is reduced, or the work function of the surface of the emitters 1 is increased, thus gradually reducing the emission current.

Then, a negative voltage of −70 V is applied from the gate power supply 4 to the gate electrodes 3, and then left to stand for a certain period of time during which the residual gases adsorbed to the surface of the emitters 1 are released. Therefore, the surface of the emitters 1 is cleaned.

Figure 4:
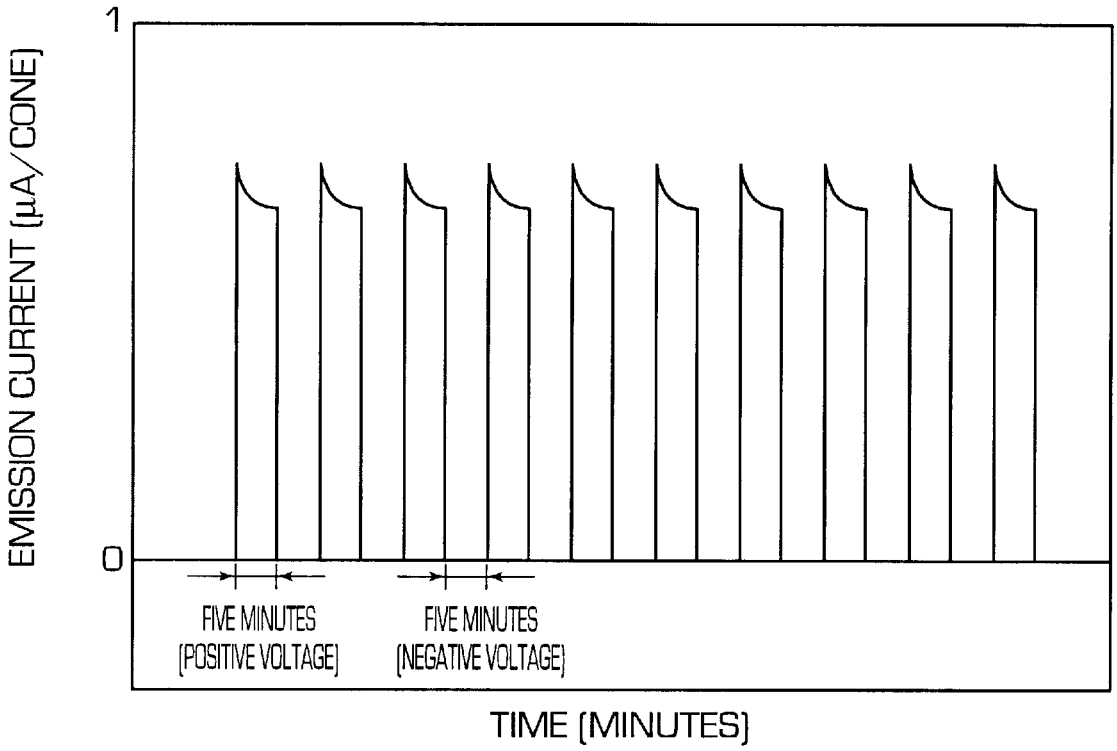
FIG. 4 is a diagram showing the manner in which the value of an emission current varies when a positive voltage of 70 V and a negative voltage are alternately applied from a gate power supply to a gate electrode in the driving apparatus for driving the field emission cold cathode device shown in FIG. 3.

When a positive voltage of 70 V is applied from the gate power supply 4 to the gate electrodes 3 for 5 minutes and thereafter a negative voltage of −70 V is applied from the gate power supply 4 to the gate electrodes 3 for 5 minutes as shown in FIG. 4, the emission current is recovered to substantially the same level as that at which the positive voltage starts to be applied.

The period of time in which the negative voltage is applied from the gate power supply 4 to the gate electrodes 3 needs to be shorter than the period of time in which the positive voltage is applied from the gate power supply 4 to the plural gate electrodes 3.

Figure 5:
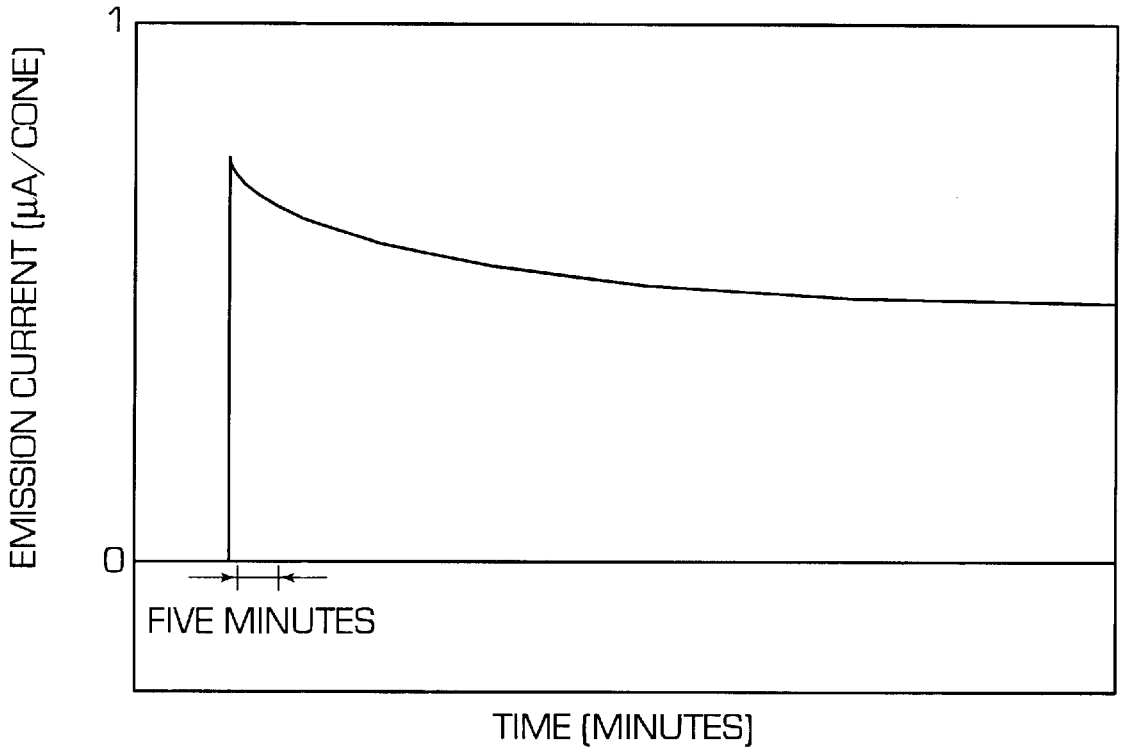
FIG. 5 is a diagram showing the manner in which the value of an emission current varies when only a positive voltage of 70 V is applied from the gate power supply to the gate electrode in the driving apparatus for driving the field emission cold cathode device shown in FIG. 3.

When only a positive voltage of 70 V is continuously applied from the gate power supply 4 to the gate electrodes 3 as shown in FIG. 5, the emission current decreases with time to a level which is about 7% of the initial level at which the positive voltage starts to be applied.

When the absolute value of the negative voltage applied from the gate power supply 4 to the gate electrodes 3 is greater than the absolute value of the positive voltage applied from the gate power supply 4 to the gate electrodes 3, the release of the adsorbed gases from the emitters 1 is promoted, allowing the period of time in which the negative voltage is applied to be shortened. Therefore, the ratio of the time in which the field emission cold cathode device emits electrons to the time in which the field emission cold cathode device operates can be increased. If the field emission cold cathode device is applied to a display device, then the luminance and operating frequency of the display device can be increased for better device performance. If the field emission cold cathode device is applied to a high-speed device such as a traveling-wave tube, the amount of effective emission can be increased for a higher output rate and a higher frequency.

When the absolute value of the negative voltage applied from the gate power supply 4 to the gate electrodes 3 is smaller than the absolute value of the positive voltage applied from the gate power supply 4 to the gate electrodes 3, the release of the adsorbed gases from the emitters 1 may also be promoted if the period of time in which the voltages are applied is adjusted.

Figure 6:
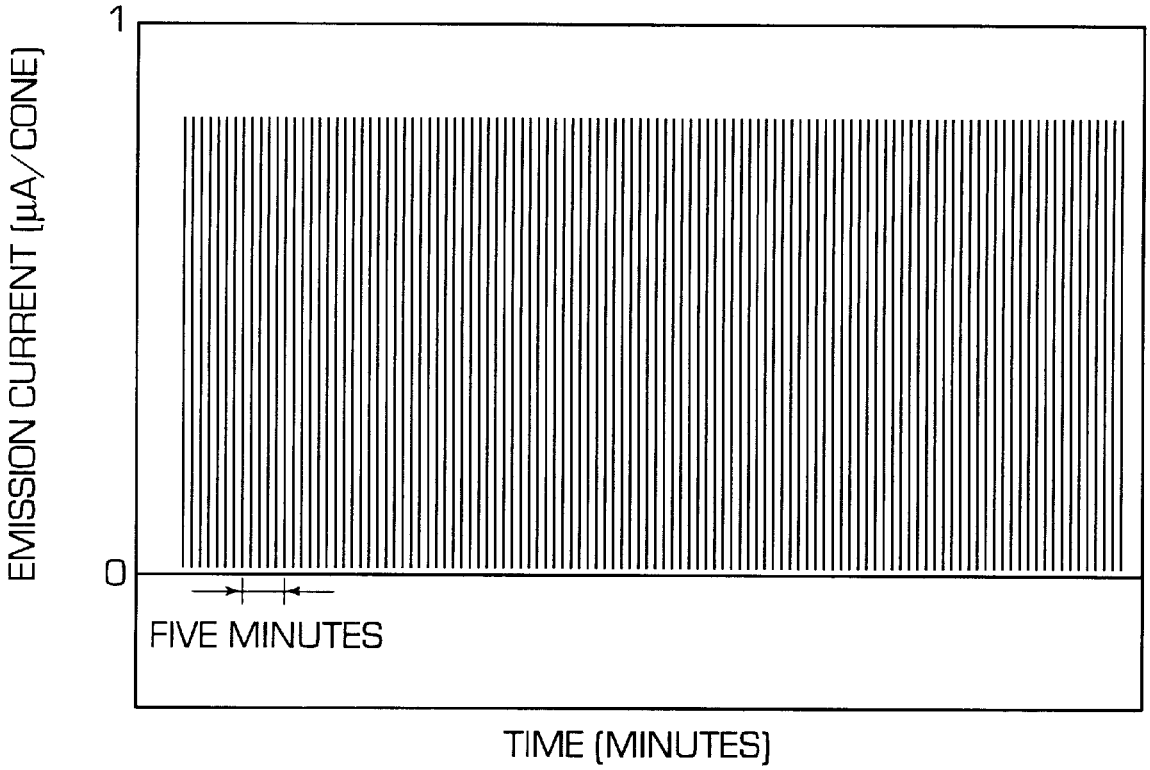
FIG. 6 is a diagram showing the manner in which the value of an emission current varies when a positive voltage of 70 V for 50 $\mu$s and a negative voltage of −70 V for 10 $\mu$s are alternately applied from the gate power supply to the gate electrode in the driving apparatus for driving the field emission cold cathode device shown in FIG. 3.

When the period of time in which the positive voltage is applied is small as shown in FIG. 6, a reduction in the emission current during that period of time is inappreciably small. However, applying a negative voltage after the positive voltage is applied prevents any reduction in the emission current from being observed over a long period of time.

As described above, the application of a negative voltage regardless of the period of time in which the negative voltage is applied is effective to prevent reduction in the emission current.

A reduction in the emission current depends on the amount of residual gases and the vacuum in the metal chamber. However, in order to recover the emission current to substantially the same level as its initial level, the absolute value of the negative voltage applied from the gate power supply 4 to the gate electrodes 3 and the period of time in which to apply the negative voltage should be selected to satisfy the following relationship:

$$V_f \cdot t_f \leq 0.1 \cdot V_r \cdot t_r \quad \ldots (2)$$

where $V_f$ represents the absolute value of the positive voltage applied from the gate power supply 4 to the gate electrodes 3, $t_f$ the period of time in which to apply the positive voltage, $V_r$ the absolute value of the negative voltage applied from the gate power supply 4 to the gate electrodes 3, and $t_r$ the period of time in which to apply the negative voltage.

Figure 7:
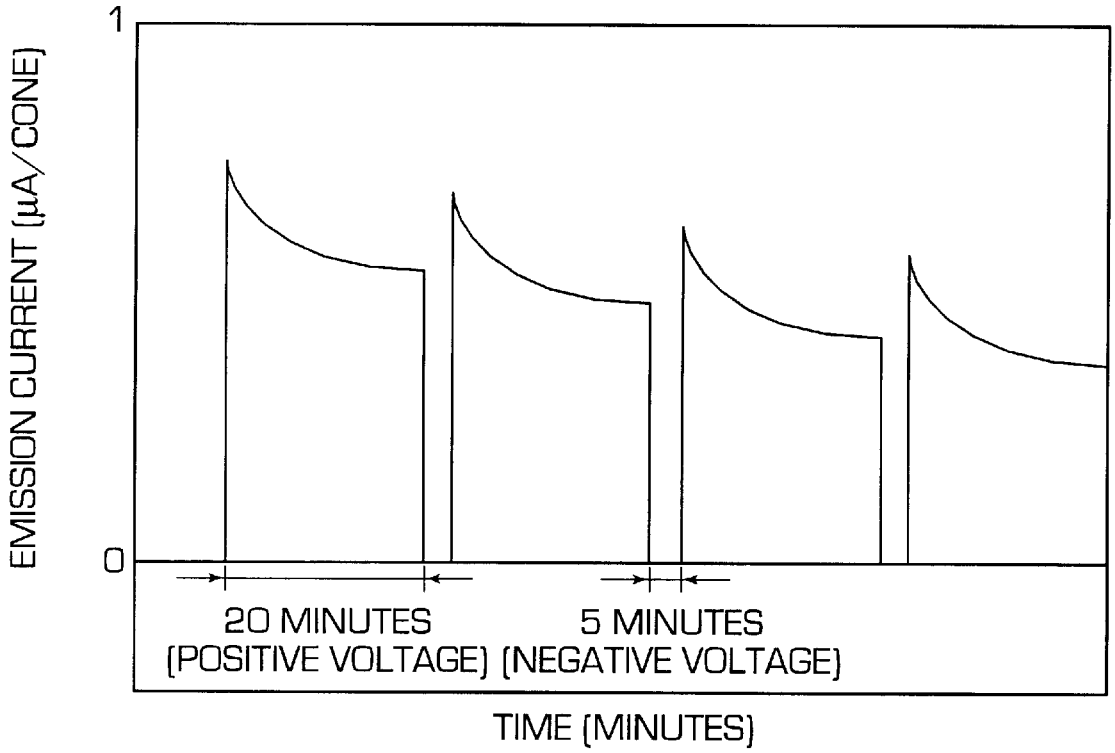
FIG. 7 is a diagram showing the manner in which the value of an emission current varies when a positive voltage of 70 V for 20 minutes and a negative voltage of −5 V for 1 minute are alternately applied from the gate power supply to the gate electrode in the driving apparatus for driving the field emission cold cathode device shown in FIG. 3.

If a positive voltage of 70 V for 20 minutes and a negative voltage of −5 V for 1 minute are alternately applied from the gate power supply 4 to the gate electrodes 3 in the driving apparatus for driving the field emission cold cathode device shown in FIG. 3, as shown in FIG. 7, then the emission current after the negative voltage is applied is greater than the emission current before the negative voltage is applied, but is smaller than the initial value before the positive voltage is applied.

If a positive voltage of 70 V for 20 minutes and a negative voltage of −5 V for 1 minute are repeatedly alternately applied from the gate power supply 4 to the gate electrodes 3, the emission current is recovered, but decreases from the preceding value thereof. The emission current gradually decreases as the number of times that the voltages are applied increases. If the field emission cold cathode device is used as a display device, such a reduction in the emission current is responsible for a reduction in luminance and color irregularities.

Figure 8:
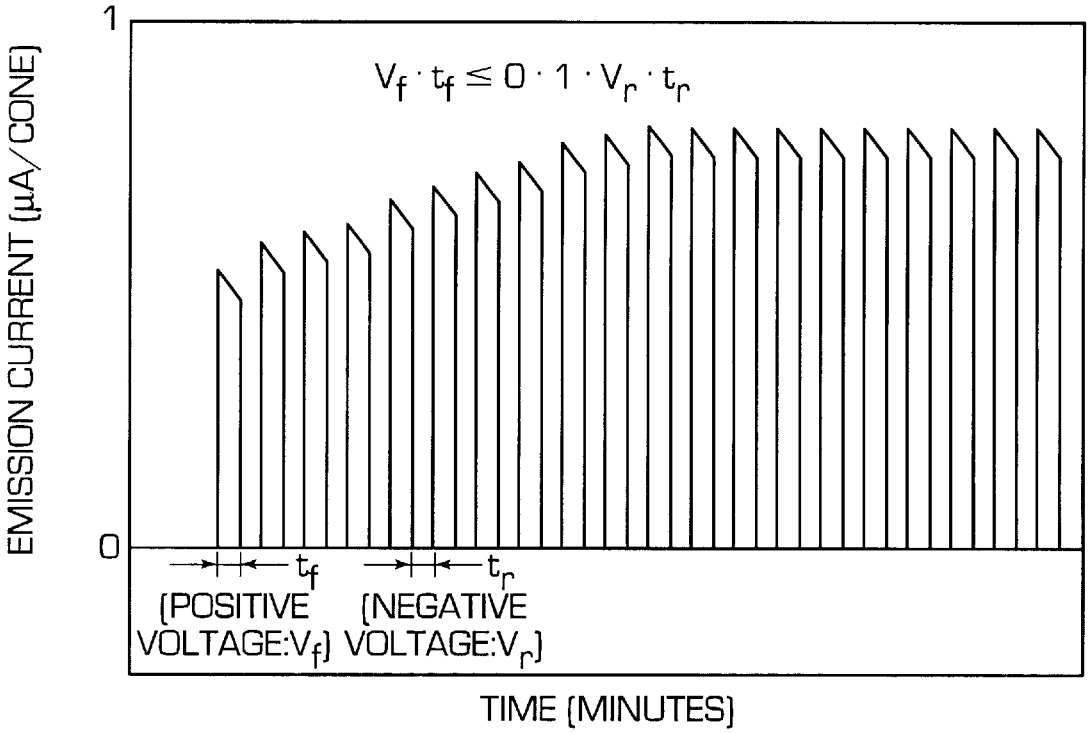
FIG. 8 is a diagram showing the manner in which the value of an emission current varies when the absolute value of the negative voltage applied from the gate power supply to the gate electrode and the period of time in which the negative voltage is applied are controlled while monitoring the emission current in a method of driving a field emission cold cathode device according to another embodiment of the present invention.

FIG. 8 is illustrative of a method of driving a field emission cold cathode device according to another embodiment of the present invention. If the absolute value of the negative voltage applied from the gate power supply to the gate electrodes and the period of time in which the negative voltage is applied are controlled while monitoring the emission current, such that when the emission current is smaller than a predetermined setting, the absolute value of the negative voltage is increased or the period of time in which the negative voltage is applied is increased, and when the emission current is greater than the predetermined setting, the absolute value of the negative voltage is reduced or the period of time in which the negative voltage is applied is reduced, then the value of the emission current varies as shown in FIG. 8.

Figure 9:
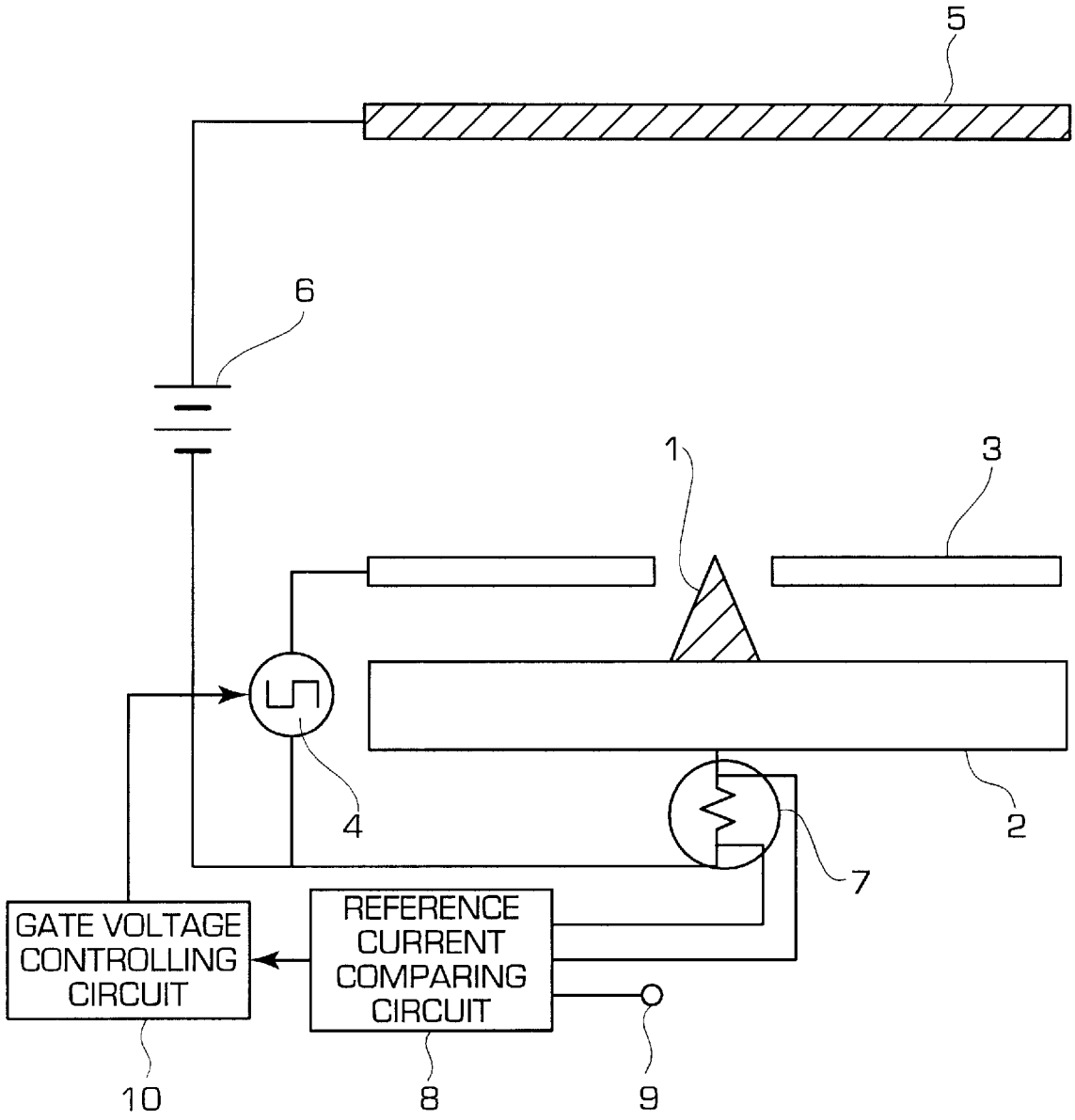
FIG. 9 is a diagram of a field emission cold cathode electron gun according to the present invention, to which the method of driving a field emission cold cathode device as shown in FIG. 8 is applied.

FIG. 9 shows a field emission cold cathode electron gun according to the present invention, to which the method of driving a field emission cold cathode device as shown in FIG. 8 is applied. The field emission cold cathode electron gun shown in FIG. 9 is a combination of the field emission cold cathode device shown in FIG. 3 and other components including a current monitor 7 as a current detecting means for detecting an emission current, a reference current comparing circuit 8 as a comparing means for comparing an emission current detected by the current monitor 7 with a predetermined reference current 9 and producing an output signal indicative of a compared result, and a gate voltage controlling circuit 10 as a voltage controlling means for controlling the value of a negative voltage applied from the gate power supply 4 to the gate electrodes 3 and the period of time in which the negative voltage is applied, on the basis of the compared result from the reference current comparing circuit 8.

The field emission cold cathode electron gun shown in FIG. 9 operates as follows: The emission current detected by the current monitor 7 is compared with the predetermined reference current 9 by the reference current comparing circuit 8. Thereafter, the voltage controlling circuit 10 controls the value of a negative voltage applied from the gate power supply 4 to the gate electrodes 3 and the period of time in which the negative voltage is applied such that the emission current will be equalized with the predetermined reference current 9, on the basis of the compared result from the reference current comparing circuit 8.

While preferred embodiments of the present invention have been described using specific terms, such description is for illustrative purposes only, and it is to be understood that changes and variations may be made without departing from the spirit or scope of the following claims.

What is claimed is:

1. A method of driving a field emission cold cathode device comprising the step of:

applying a positive voltage with reference to OV to a gate electrode disposed near an emitter; and applying a negative voltage with reference to OV to the gate electrode at a predetermined time alternately with said positive voltage;

establishing said negative voltage in order to satisfy the relationship:

$V_f < V_r$ where $V_f$ represents the absolute value of said positive voltage and $V_r$ the absolute value of said negative voltage, wherein said alternatively applied positive and negative voltages maintain a substantially constant emission current from said emitter.

2. A method according to claim 1, further comprising the step of:

establishing said negative voltage and a period of time in which said negative voltage is applied to the gate electrodes in order to also satisfy the relationship:

$t_f > t_r$ where $t_f$ represents a period of time in which said positive voltage is applied to the gate electrode, $t_r$ a period of time in which said negative voltage is applied to the gate electrode.

3. A method according to claim 2, further comprising the step of:

establishing said negative voltage and a period of time in which said negative voltage is applied to the gate electrode are selected in order to further satisfy the relationship:

$V_f \cdot t_f \leqq 0.1 V_r \cdot t_r$ where $V_f$ represents the absolute value of said positive voltage, $V_r$ the absolute value of said negative voltage, $t_f$ a period of time in which said positive voltage is applied to the gate electrode, and $t_r$ a period of time in which said negative voltage is applied to the gate electrode.

4. A method according to claim 1, further comprising the step of:

establishing said negative voltage and a period of time in which said negative voltage is applied to the gate electrode are selected in order to further satisfy the relationship:

$V_f \cdot t_f \leqq 0.1 \cdot V_r \cdot t_r$ where $V_f$ represents the absolute value of said positive voltage, $V_r$ the absolute value of said negative voltage, $t_f$ a period of time in which said positive voltage is applied to the gate electrode, and $t_r$ a period of time in which said negative voltage is applied to the gate electrode.

5. A method of driving a field emission cold cathode device comprising the step of:

applying a positive voltage with reference to OV to a gate electrode disposed near an emitter; and applying a negative voltage with reference to OV to the gate electrode at a predetermined time alternately with said positive voltage;

establishing a period of time in which said negative voltage is applied to the gate electrode in order to satisfy the relationship:

$t_f > t_r$ where $t_f$ represents a period of time in which said positive voltage is applied to the gate electrode and $t_r$ the period of time in which said negative voltage is applied to the gate electrode, wherein said alternatively applied positive and negative voltages maintain a substantially constant emission current from said emitter.

6. A method according to claim 5, further comprising the step of:

establishing said negative voltage and a period of time in which said negative voltage is applied to the gate electrode are selected in order to further satisfy the relationship:

$V_f \cdot t_f \leqq 0.1 \cdot V_r \cdot t_r$ where $V_f$ represents the absolute value of said positive voltage, $V_r$ the absolute value of said negative voltage, $t_f$ a period of time in which said positive voltage is applied to the gate electrode, and $t_r$ a period of time in which said negative voltage is applied to the gate electrode.

7. A method of driving a field emission cold cathode device comprising the step of:

applying a positive voltage with reference to OV to a gate electrode disposed near an emitter; and applying a negative voltage with reference to OV to the gate electrode at a predetermined time alternately with said positive voltage;

establishing said negative voltage and a period of time in which said negative voltage is applied to the gate electrode are selected in order to satisfy the relationship:

$V_f \cdot t_f \leqq 0.1 \cdot V_r \cdot t_r$ where $V_f$ represents the absolute value of said positive voltage, $V_r$ the absolute value of said negative voltage, $t_f$ a period of time in which said positive voltage is applied to the gate electrode, and $t_r$ a period of time in which said negative voltage is applied to the gate electrode, wherein said alternatively applied positive and negative voltages maintain a substantially constant emission current from said emitter.

8. A method of driving a field emission cold cathode device comprising the step of:

applying a positive voltage with reference to OV to a gate electrode disposed near an emitter; and applying a negative voltage with reference to OV to the gate electrode at a predetermined time alternately with said positive voltage;

establishing said negative voltage and a period of time in which said negative voltage is applied to the gate electrode in order to maintain a substantially constant emission current from said emitter with a predetermined setting when said positive voltage is applied to said gate electrode.

9. A field emission cold cathode electron gun comprising:

a field emission cold cathode device having an emitter and a gate electrode disposed respectively near said emitter;

a gate power supply for alternately applying a positive voltage with reference to OV and a negative voltage with reference to OV to said gate electrode;

current detecting means for detecting an emission current from said emitter when the positive voltage with reference to OV is applied to said gate electrode;

comparing means for comparing an emission current detected by said current detecting means with a predetermined value and producing an output signal indicative of a compared result; and voltage controlling means for controlling the value of the negative voltage with reference to OV applied from said gate power supply to said gate electrode and a period of time in which to apply the negative voltage with reference to OV, based on the compared result form said comparing means, in order maintain said emission as substantially constant.

* * * * *